US010934656B2

(12) United States Patent
Noltin et al.

(10) Patent No.: US 10,934,656 B2
(45) Date of Patent: Mar. 2, 2021

(54) WASHER EXTRACTOR MACHINE WITH IMPROVED DOOR CLOSING SENSING SYSTEM

(71) Applicant: Ellis Corporation, Itasca, IL (US)

(72) Inventors: Daniel W. Noltin, Addison, IL (US); William J. Humecke, Wheaton, IL (US); Robert H. Fesmire, Geneva, IL (US)

(73) Assignee: Ellis Corporation, Itasca, IL (US)

( * ) Notice: Subject to any disclaimer, the term of this patent is extended or adjusted under 35 U.S.C. 154(b) by 248 days.

(21) Appl. No.: 15/882,515

(22) Filed: Jan. 29, 2018

(65) Prior Publication Data

US 2019/0048507 A1 Feb. 14, 2019

Related U.S. Application Data

(60) Provisional application No. 62/543,498, filed on Aug. 10, 2017.

(51) Int. Cl.

| | |
|---|---|
| ***D06F 37/42*** | (2006.01) |
| ***D06F 39/14*** | (2006.01) |
| ***D06F 33/00*** | (2020.01) |
| *D06F 37/18* | (2006.01) |

(52) U.S. Cl.

CPC ..... *D06F 37/42* (2013.01); *D06F 33/00* (2013.01); *D06F 39/14* (2013.01); *D06F 37/18* (2013.01)

(58) Field of Classification Search

CPC ..... D06F 37/18; D06F 37/42; D06F 33/00; D06F 39/14

USPC ..... 68/12.27

See application file for complete search history.

(56) References Cited

U.S. PATENT DOCUMENTS 5,870,787 A * 2/1999 Choi ..... D06F 39/14 8/159

2016/0326687 A1* 11/2016 Jo ..... D06F 37/265

FOREIGN PATENT DOCUMENTS

DE 10003474 A1 * 8/2000 ..... D06F 37/302

OTHER PUBLICATIONS

DE10003474A1—Machine translation (Year: 2011).*

* cited by examiner

*Primary Examiner* — Tinsae B Ayalew

(74) *Attorney, Agent, or Firm* — Leydig, Voit & Mayer, Ltd.

(57) ABSTRACT

A washer extractor machine is provided. The washer extractor machine includes a casing defining an interior chamber that is accessed through a first opening in the casing that has an associated outer door. A cylinder body is supported for rotation in the interior chamber of the casing. The cylinder body has a hollow interior that is accessed through a second opening in the cylinder body. An inner door is supported on the cylinder body for movement relative to the second opening between open and closed positions. A door closing sensing system includes a sensor element and a target element supported on the inner door. The sensor element and the target element being arranged relative to one another such that the target is in alignment with the line-of-sight of the sensor element when the inner door is in the closed position.

16 Claims, 6 Drawing Sheets

WASHER EXTRACTOR MACHINE WITH IMPROVED DOOR CLOSING SENSING SYSTEM

CROSS-REFERENCE TO RELATED APPLICATIONS

This patent application claims the benefit of U.S. Provisional Patent Application No. 62/543,498, filed Aug. 10, 2017, which is incorporated by reference.

BACKGROUND OF THE INVENTION

Commercial washing and extracting machines are well suited for washing large loads of laundry material in institutions such as hospitals and hotels. Commercial/industrial laundry machines typically are large in size (i.e., 100 to 1200 pound in capacity) for laundering large amounts of items simultaneously. A side loading washer extractor is one type of industrial washing machine. A side loading washer extractor generally includes an inner washing cylinder assembly that rotates within a casing. The washing cylinder assembly typically has one or more inner doors in the side of the washing cylinder through which laundry maybe loaded into and unloaded from the cylinder. Additionally, the casing includes outer doors, which allow an operator to access the cylinder.

In a wash cycle, the outer door closes over the inner door and the washer extractor rotates the washing cylinder, and with it the laundry, inside the casing. Problems can arise during the wash cycle if any of the inner doors are left open. In particular, laundry can escape the washing cylinder and jam the washer extractor machine. Jams of the washer extractor can result in machine downtime and as well as possible damage to the machine, both of which can increase the cost of operating the washer extractor U.S. Pat. No. 9,689,103 discloses a door locking mechanism for an industrial washing machine. The door locking mechanism has an associated optical sensor that determines whether the locking mechanism has rotated to the locked position. The disclosed system has several problems. For example, the sensor does not determine whether the door has actually closed, only whether lock has rotated to the closed position. This along with the use of an optical sensor makes the system easy to override by an operator looking to operate the machine more quickly. Additionally, the system does not have a robust design making the system susceptible to failure. This is a particular problem in the harsh environment of a commercial laundry facility in which equipment is exposed to water, steam, corrosive chemicals, heat and vibration. Moreover, the process of loading and unloading the washer can lead to damage of the lock sensing system.

BRIEF SUMMARY OF THE INVENTION

In view of the foregoing, an object of the invention is to provide a door sensing system for an industrial washer extractor machine that reliably determines whether a door of the washer extractor is in the closed position prior to initiation of a wash cycle.

A further object of the present invention is to provide a door sensing system for a washer extractor that is robust in design and capable of operating for prolonged periods of time in the harsh environment of a commercial laundry facility.

A further object of the invention is provide a door sensing system for a washer extractor that is difficult for an operator to override.

Another object of the invention is provide a door sensing system for a washer extractor that can be retro-fitted onto existing washer extractor machines.

BRIEF DESCRIPTION OF THE SEVERAL VIEWS OF THE DRAWING(S)

DETAILED DESCRIPTION OF THE INVENTION

Figure 1:
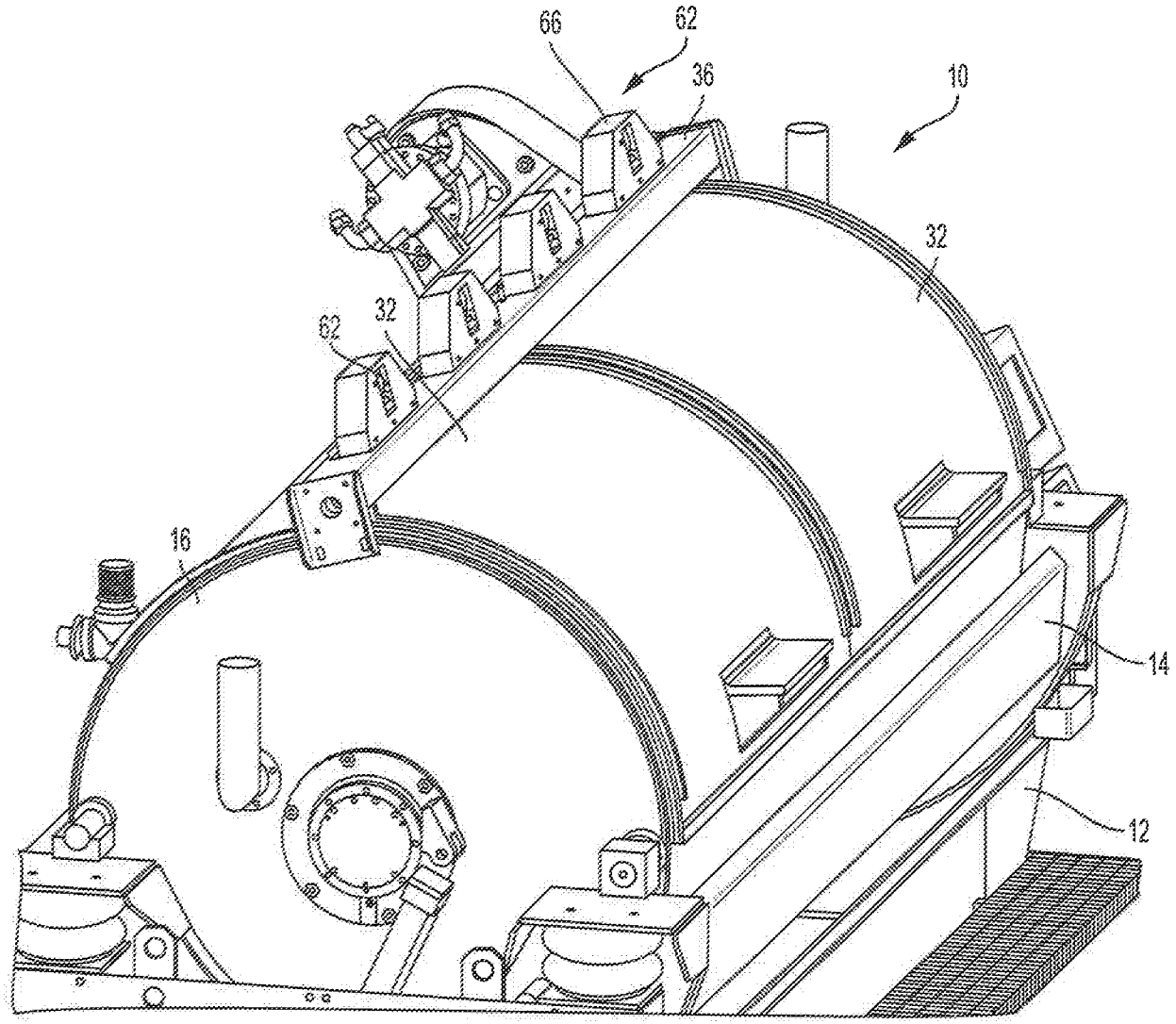
FIG. 1 is a perspective view of an exemplary washer extractor machine according to the present disclosure showing the outer doors in the closed position

The present disclosure relates generally to washer extractor machines such as can be used in commercial laundry facilities and particularly to a washer extractor having an inner and outer door arrangement. Referring to FIG. 1 of the drawings there is shown an exemplary side loading washer extractor machine 10. The washer extractor 10 of FIG. 1 generally includes a frame 12 that supports a cradle 14, which together act as a base and provide a suspension system for the washer extractor. The cradle 14, in turn, supports a casing 16 that defines an interior chamber 18 within which a cylinder assembly 20 is supported for rotation relative to the casing. For rotating the cylinder assembly 20, the cradle 14 includes a drive assembly 22 (best shown in FIG. 2), which in this case is arranged on one end of the cradle 14. The interior chamber 18 of the casing 16 also provides the space into which the water and cleaning chemicals are introduced during a washing cycle. Accordingly, the interior chamber 18 of the casing 16 may have a diameter that is slightly larger than the diameter of the cylinder assembly 20. The casing 16 may be made of a material, such as stainless steel, that is resistant to corrosion and other damage resulting from exposure to water and cleaning chemicals.

Figure 6:
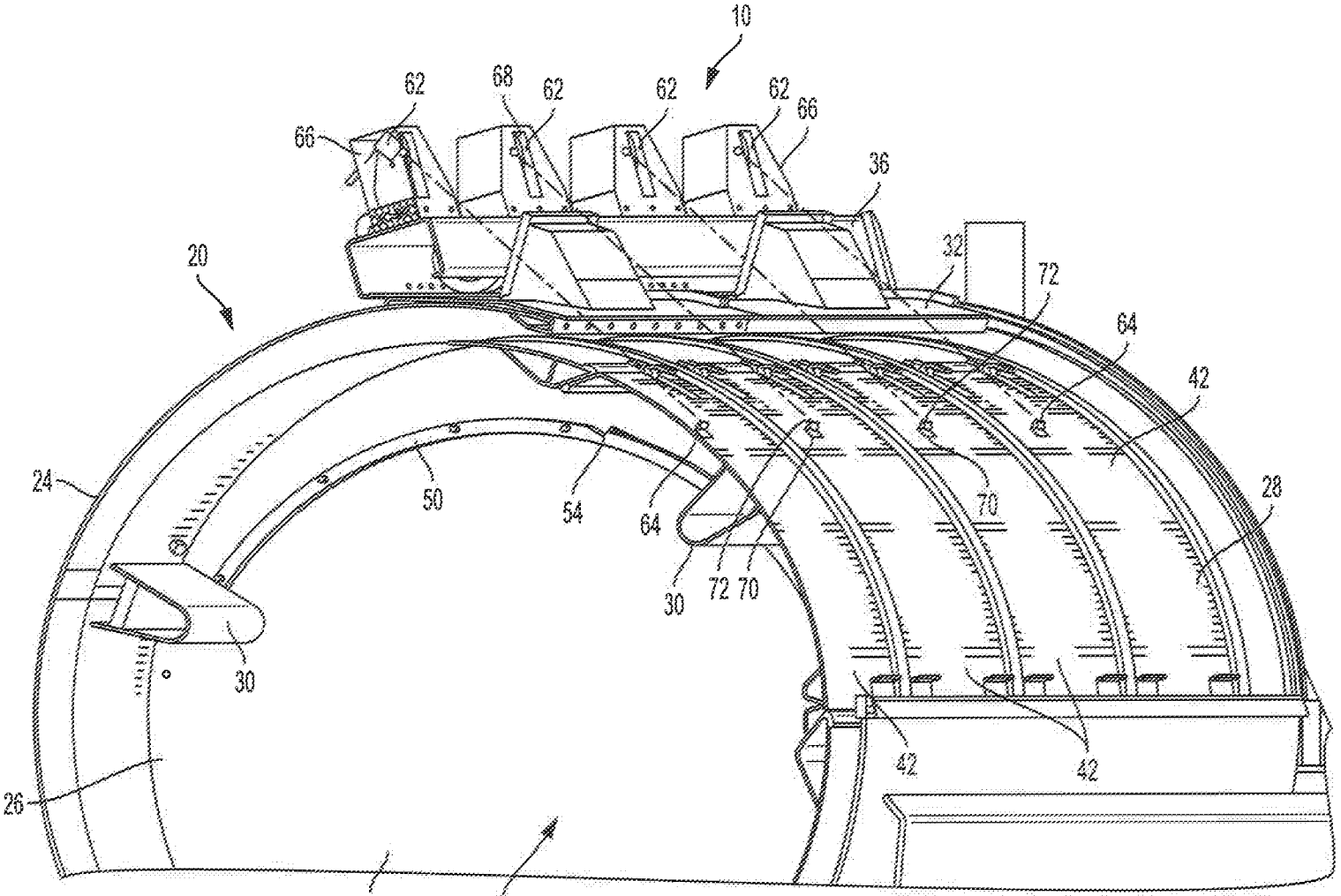
FIG. 6 is a perspective sectional view of the washer extractor of FIG. 1 showing the inner doors in the closed position.
Figure 7:
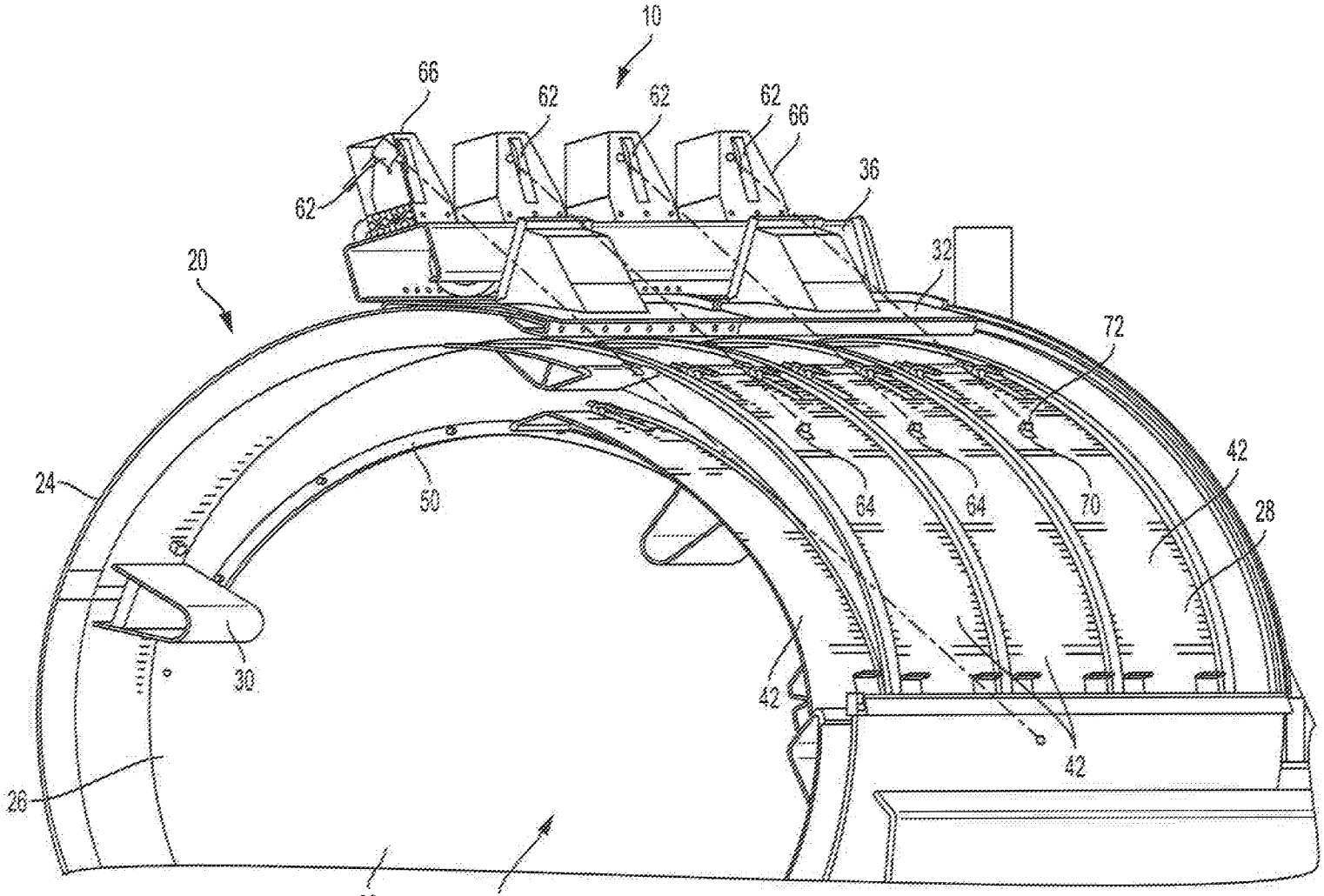
FIG. 7 is a perspective sectional view of the washer extractor of FIG. 1 showing one inner door in the first lowered position.
Figure 8:
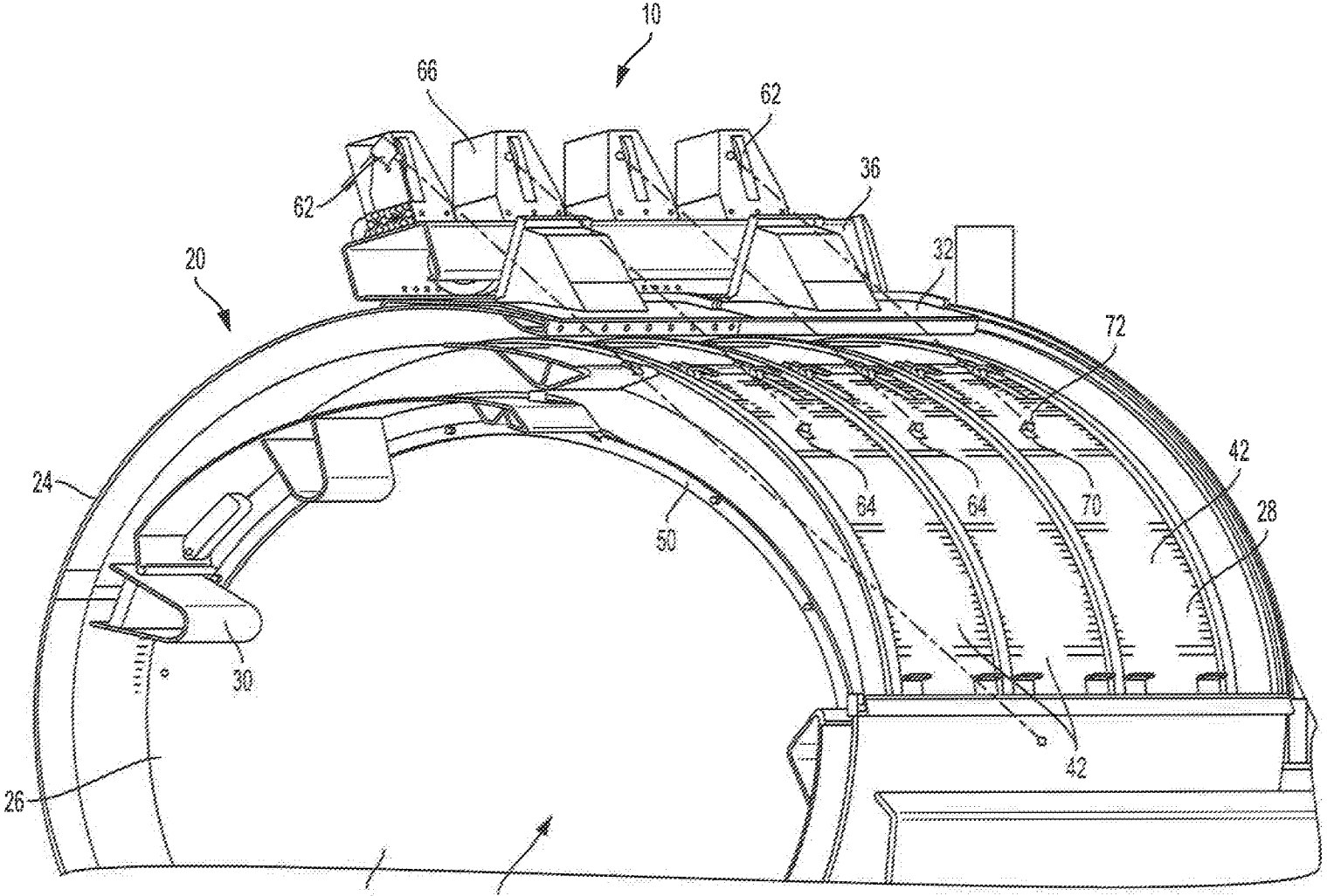
FIG. 8 is a perspective sectional view of the washer extractor of FIG. 1 showing one inner door in the second retracted position.

The cylinder assembly 20 may include a cylinder body 24 that is supported for rotation in the interior chamber 18 of the casing 16. The cylinder body 24 is configured to hold the laundry during a washing cycle. To this end, as best shown in FIGS. 6-8, the cylinder body 24 may have a hollow interior 26 that holds the laundry and a perforated sidewall 28 that allows the water and cleaning chemicals in the casing 16 to reach the laundry in the interior of the cylinder body 24. The interior of the cylinder body 24 may further include a series of circumferentially spaced ribs 30 (see FIGS. 6-8) that are arranged on the interior of the sidewall 28 in order to help agitate the laundry. The cylinder body 24 can be made of any appropriate material including, for example, stainless steel. Additionally, the cylinder body 24 can be any desired length and diameter.

Figure 2:
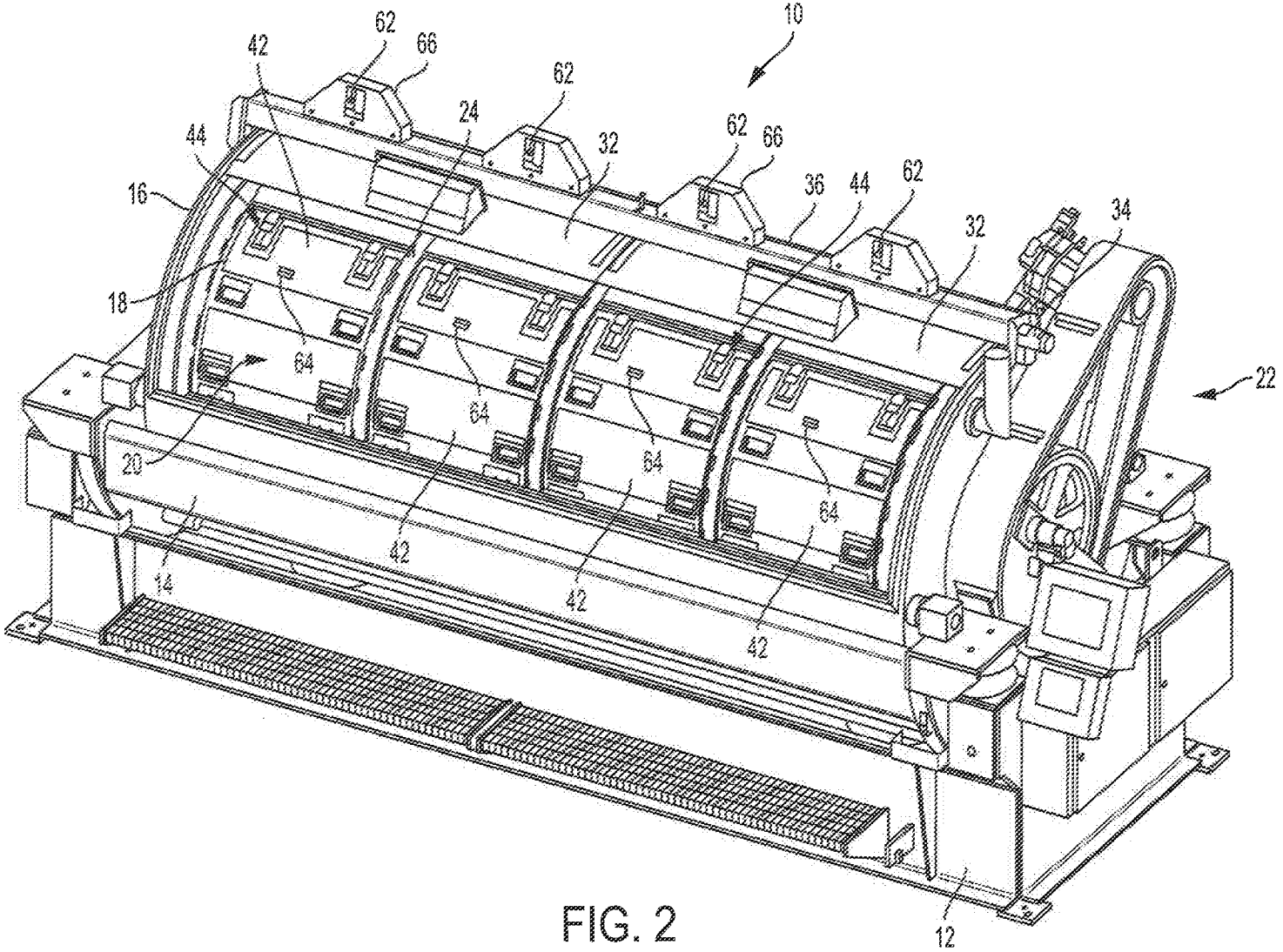
FIG. 2 is a front perspective view of the washer extractor of FIG. 1 showing the outer doors in the open position and the inner doors in the closed position.

To allow for access to the cylinder body 24 for the loading and unloading of laundry, the casing 16 may be provided with one or more outer doors 32 that, in this case, are arranged on the side of the casing 16. In the illustrated embodiment, as shown in FIGS. 1 and 2, the casing 16 includes two outer doors 32 however, any number of outer doors may be provided depending, for example, upon the size of the washer extractor 10. Each outer door 32 is configured to move between open (see, e.g., FIG. 2) and closed (see FIG. 1) positions relative to an opening in the casing 16. In the open position, the opening in the casing 16 is accessible. In the closed position, the outer doors 32 close off the opening in the casing 16. In this case, the outer doors 32 pivot upward when moving from the closed to the open positions.

The outer doors 32 may have one or more associated drive mechanisms 34 (shown, for example in FIG. 2) that drive movement of one or more of the outer doors between the open (see, e.g., FIG. 2) and closed (see FIG. 1) positions. Each drive mechanism 34 may include, for example, one or more motors that power movement of the outer doors 32. A single drive mechanism 34 may be provided that drives movement of multiple outer doors 32 or each outer door 32 may have its own drive mechanism 34. Thus, as used herein, the term drive mechanism is intended to cover both a single drive mechanism or multiple drive mechanisms. The drive mechanism 34, including the associated motors, may be supported on the casing 16. More particularly, in the illustrated embodiment, the drive mechanism 34 is at least partially supported on an upper beam 36 on an upper portion of the casing 16 that spans the length of the casing. The drive mechanism 34 for the outer doors 32 may be configured to move each of the outer doors independently, i.e. such that the outer doors may be moved separately between the open and closed positions. The outer doors 32 also may be configured to be manually operated either as an alternative to the drive mechanism 34 or in combination with the drive mechanism.

The interior chamber 26 of the cylinder body 24 may be divided by interior walls 38 into multiple pockets 40 for holding laundry. In the illustrated embodiment, the cylinder body 34 is divided into four pockets 40 with one of the interior walls 38 dividing the pockets 40 being shown in the cross-sections of FIGS. 6-8. However, the present disclosure is not limited to cylinder bodies 24 that are divided into multiple pockets. Rather, the present disclosure is equally applicable to cylinder bodies that are not divided into separate pockets as well as those that are divided into two or more pockets.

To provide access to the interiors of the individual pockets 40, the cylinder body 24 may include an inner door 42 that controls access to an opening in the cylinder body 24 for each pocket 40. As the illustrated cylinder body 24 is divided into four pockets, four inner doors 42 and four corresponding door openings are provided; however, the present disclosure is applicable to any cylinder body having at least one inner door. The inner doors 42 and the cylinder body 24 are configured such that each inner door is capable of moving between a closed position shown for example in FIGS. 3 and 6, and an open position. In this case, each inner door 42 can be held in a lowered position shown for example in FIGS. 4 and 7 between the retracted, open position shown in FIGS. 5 and 8 and the closed position shown in FIGS. 3 and 6.

Figure 4:
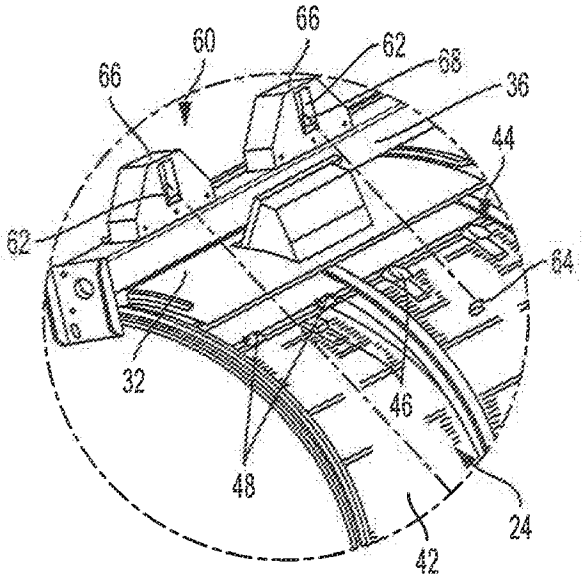
FIG. 4 is an enlarged perspective view of the door sensing system of the washer extractor of FIG. 1 showing the inner doors in a first lowered position.
Figure 3:
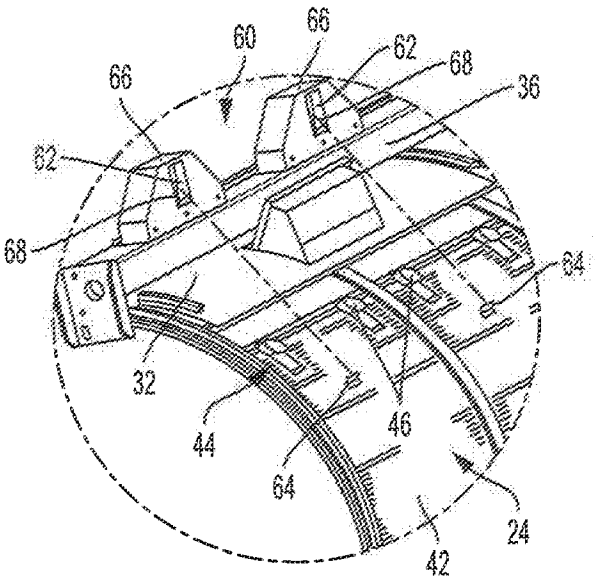
FIG. 3 is an enlarged perspective view of the door sensing system of the washer extractor of FIG. 1 showing the inner doors in the closed position.

To help secure the inner door 42 in the closed position, each inner door can include an associated latching mechanism 44, which in this case includes a spring-loaded arm 46 arranged on the outer face of the inner door 42 as shown, for example, in FIGS. 3 and 4. When the inner door 42 is moved into the closed position, this arm 46 engages with a wear pad 48 on the cylinder body 24. These wear pads 48 are visible in FIGS. 4 and 5 with the inner door 42 in the open position. When opening the inner door 42, an operator can first disengage the latch mechanism 44 by pivoting the arms 46 out of engagement with the wear pads 48.

To facilitate movement of the individual inner doors 42, each pocket 40 of the cylinder body 24 includes two door runners 50, one on each interior sidewall 38 of the pocket. These runners 50 are configured to catch the respective inner door 42 and assist an operator in manually moving the inner door 42 back and forth between the open and closed positions. More specifically, each runner 50 extends along an arcuate path (see FIGS. 6-8) in which the runner is spaced further from the door opening 52 in the radial direction of the cylinder body 24 as the runner 50 extends from the lower end of the door opening 52 to the upper end of the door opening. Thus, at the upper end of the door opening, the runners 50 are spaced further from the door opening 52 than at the lower end of the door opening.

With this arrangement, when opening the inner door 42 from the closed position after the latch mechanism 44 is disengaged, the upper end of the inner door 42 is first lowered or dropped radially inward until it engages with the runners 50. This lowered position is shown in FIG. 7. To help hold the inner door 42 in this position, each runner 50 may include an indentation 54 (best shown in FIG. 6), within which the upper end of the inner door 42 can engage to prevent the door from sliding downward as shown in FIG. 7. Once an operator disengages the inner door 42 from the runner indentations 54, the inner door 42 can then be slid downward on the runners 50 to the fully retracted, open position shown in FIG. 8. To close the inner door 42 from this fully retracted, open position, an operator first slides the inner door 42 upward into engagement with the indentations 54 in the runners 50. From this lowered position, an operator can then pull the upper end of the inner door 42 radially outward into a position in which the latching mechanism 44 can engage with the cylinder body 24. While the inner door 42 of the illustrated embodiment has a specific two-step opening process, the present disclosure is applicable to any type of inner door that moves between open and closed positions.

To facilitate engagement of the inner door 42 with the corresponding door opening 52 in the cylinder body 24, the edges of the inner door 42 may have a wedge construction that matches the angle of the door opening. Thus, the inner door 42 acts as a tapered plug that is driven into engagement with the door opening in the cylinder body 24 by the pounding action of the laundry during a washing operation. The inner door, however, can have other configurations.

Figure 5:
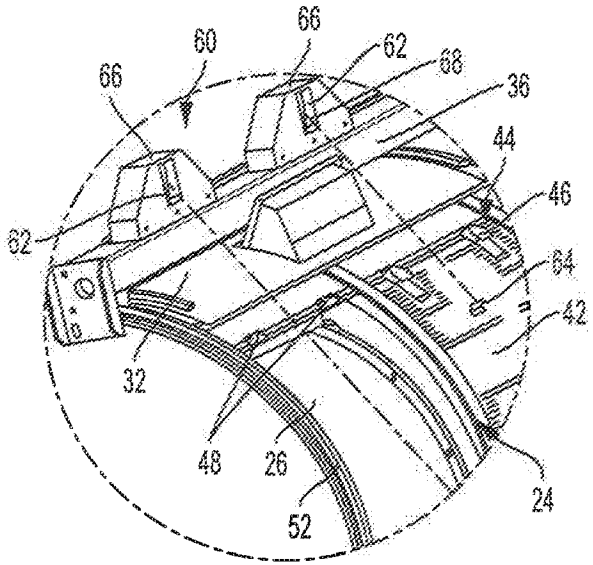
FIG. 5 is an enlarged perspective view of the door sensing system of the washer extractor of FIG. 1 showing the inner doors in a second retracted position.

To help ensure that all of the inner doors 42 on the cylinder assembly 20 are completely closed prior to the initiation of a washing operation, a door closing sensing system 60 may be provided as shown in FIGS. 3-5. In particular, the door closing sensing system 60 may be configured to provide an indication when one or more of the inner doors 42 are closed and/or open. The door sensing system 60 may include a sensor element 62 and a target 64 for each of the inner doors 42. As shown in FIGS. 3-8, the sensor element 62 for each inner door 42 may be mounted on the casing 16 while the target 64 may be arranged on the outer surface of the corresponding outer door 42. The sensor element 62 may have a line-of-sight and the sensor element 62 and target 64 may be arranged relative to one another such that the target 64 is in alignment with the line-of-sight of the sensor element 62 when the inner door 42 is in the closed position.

According to one embodiment, the upper beam 36 of the casing 16 provides a convenient location for the mounting of the sensor element 62. In particular, the upper beam 36 provides the sensor element 62 with a clear line-of-sight to the respective inner door 42. Additionally, the upper beam 36 places the sensor element 62 away from the door opening in the cylinder body 24 through which the laundry is loaded and unloaded. Thus, the sensor element 62 does not interfere with the loading and unloading of laundry relative to the cylinder body 24 and is less subject to damage resulting from collisions, snags and the like with the bags used during the laundry loading and unloading process. The upper beam 36 is also an advantageous mounting location because many existing washer extractors have a casing with an upper beam allowing the door sensing system 60 to be readily retrofitted onto existing washer extractors. To help shield the sensor element 62 from damage, it may be contained on the upper beam 36 within a housing 66 that surrounds the sensor element 62 and defines a window 68 (see FIGS. 3-5) that is configured to provide the sensor element 62 with a clear line of sight to the target 64 when the inner door 42 is in the closed position. The upper beam 36 of the casing 16 is one example of a suitable location for the sensor element 62; however, the present invention is not limited to sensor elements mounted on the upper beam, the casing or any particular location on the washer extractor. In some embodiments, the sensor element may even be mounted on a structure other than the washer extractor.

According to one embodiment, the sensor element 62 may comprise a laser time-of-flight type sensor. This type of sensor element 62 differs from retroreflective or capacitive proximity sensors in that it does not depend upon reflected light level. Instead, a laser time-of-flight type sensor measures the time of flight of photons emitted from a laser diode of the sensor element. This time of flight is independent of reflectance of the target. The use of this type of sensor element 62 allows the sensors to be placed a relatively further distance away from the door opening as compared to conventional optical sensors, which is a significant advantage when avoiding damage caused by the laundry loading and unloading process. Additionally, because a laser time of flight sensor does not rely on reflected light or induction, it cannot be easily overridden such as by placing a piece of reflective material in front of the sensor. One example of a suitable laser time-of-flight sensor is the LR-TB2000 Series All-Purpose Laser Sensor available from Keyence Corporation.

As shown in FIGS. 3-8, the target 64 for each inner door 42 may be arranged on the outer surface of the inner door at a location in which the target 64 is aligned in line-of-sight with the sensor element 62 when the inner door 42 is in the closed position (see, e.g., FIGS. 3 and 6). In the illustrated embodiment, the target 64 is spaced away from the latching mechanism 44 of the inner door 42 in a generally upper, middle portion of the outer surface of the inner door 42 and thus is able to provide an indication as to the actual position of the inner door 42 as opposed to merely an indication of the status of the latching mechanism. As shown in FIGS. 6-8, the illustrated target 62 consists of a base portion 70 that may be secured to the outer surface of the inner door 42 and an upright portion 72 that extends outward away from the outer surface of the inner door. This upright portion 72 is what is sensed by the sensor element 62 and should be sized so as not to interfere with opening and closing of the inner door 42. According to one embodiment, the target 64 may be a metal piece that is approximately 2 inches wide and extends ½ inch from the surface of the inner door.

Accordingly to one preferred embodiment, the target 64 may be made of stainless steel. Stainless steel may be used because the laser time-of-flight sensor element 62 will reflect off of stainless steel. The use of stainless steel for the targets 64 renders them particularly resistant to damage resulting from use in the harsh commercial laundry environment. Specifically, the use of stainless steel, or other similar robust, corrosion resistant materials, makes the target 64 resistant to damage caused by vibration or inadvertent contact during loading and unloading of the machine and to corrosion caused by the water, detergents and other cleaning chemicals used in the washing process or by the build-up of lint. The target 64 may be connected to the surface of the inner door 42 by any suitable method such as fasteners or welding. The use of fasteners and/or welding to secure the targets 64 to the inner door 62 again allows the door sensing system 60 to be easily retrofitted onto existing washer extractors.

Each sensor element 62 may be configured to communicate, via wired connection or other wireless means, to a controller. The controller may be configured such that if the inner doors 42 are not closed the outer doors 32 are not allowed to close and/or the washing operation is not allowed to start. Additionally, the controller may be configured to provide an audible or visual signal to an operator that one or more of the inner doors 42 are open. According to one embodiment, the controller may be further configured to determine whether the sensor elements 62 have been turning off and on at the appropriate times to ensure that a wiring change, e.g. a jumper, has not been installed in order to override any of the sensor elements 62. According to one embodiment, the controller is configured such that the washer extractor 10 is not allowed to operate unless all of the inner door sensor elements 62 are made simultaneously, i.e. when all of the inner doors 42 (no matter the number of inner doors) are in the closed position.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A washer extractor machine for washing a load of laundry, the washer extractor machine comprising:

a casing defining an interior chamber that is accessed through a first opening in the casing;

a cylinder body configured to hold laundry during a washing cycle and supported for rotation in the interior chamber of the casing, the cylinder body having a hollow interior that is accessed through a second opening in the cylinder body;

an outer door supported on the casing for movement relative to the first opening between an open position in which the first opening in the casing is accessible and a closed position in which the outer door closes off the first opening;

an inner door supported on the cylinder body for movement relative to the second opening between an open position in which the second opening in the cylinder body is accessible and a closed position in which the inner door closes off the second opening; and a door closing sensing system configured to determine whether the inner door is in the closed position, the door closing sensing system including a sensor element and a target element supported on an outer surface of the inner door, the sensor element having a line-of-sight and the sensor element and the target element being arranged relative to one another such that the target is in alignment with the line-of-sight of the sensor element when the inner door is in the closed position, and said sensor element being a time-of-flight type sensor.

2. The washer extractor of claim 1 wherein the target element is made of stainless steel.

3. The washer extractor of claim 1 wherein the inner door includes a latching mechanism and the target element is spaced away from the latching mechanism.

4. The washer extractor of claim 1 further including a drive mechanism for driving movement of the outer door between the open and closed positions.

5. The washer extractor of claim 4 wherein the drive mechanism is at least partially supported on an upper beam of the casing which spans a length of the casing.

6. The washer extractor of claim 5 wherein the sensor element is supported on the upper beam.

7. The washer extractor of claim 1 wherein the target element comprises a base portion fastened to the outer surface of the inner door and a upright portion that extends away from the outer surface of the inner door.

8. The washer extractor of claim 1 wherein the inner door is movable in a radially inward direction relative to the second opening to a lowered position between the closed position and the open position.

9. A washer extractor machine for washing a load of laundry, the washer extractor machine comprising:

a casing defining an interior chamber that is accessed through a first opening in the casing;

a cylinder body configured to hold laundry during a washing cycle and supported for rotation in the interior chamber of the casing, the cylinder body having a hollow interior that is divided into multiple pockets by at least one interior wall, each interior pocket of the cylinder body being accessible through a respective second opening in the cylinder body;

an outer door supported on the casing for movement relative to the first opening between an open position in which the first opening in the casing is accessible and a closed position in which the outer door closes off the first opening;

a plurality of inner doors each supported on the cylinder body for movement relative to a respective one of the second openings between an open position in which the respective second opening in the cylinder body is accessible and a closed position in which the inner door closes off the respective second opening; and a door closing sensing system configured to determine whether the inner doors are in the closed position, the door closing sensing system including for each inner door a sensor element and a target element supported on an outer surface of the respective inner door, the sensor element having a line-of-sight and the sensor element and the target element for each inner door being arranged relative to one another such that the target is in alignment with the line-of-sight of the sensor element when the respective inner door is in the closed position, and said sensor element being a time-of-flight type sensor.

10. The washer extractor of claim 9 wherein the target element is made of stainless steel.

11. The washer extractor of claim 9 wherein the inner door includes a latching mechanism and the target element is spaced away from the latching mechanism.

12. The washer extractor of claim 9 further including a drive mechanism for driving movement of the out door between the open and closed positions.

13. The washer extractor of claim 12 wherein the drive mechanism is at least partially supported on an upper beam of the casing which spans a length of the casing.

14. The washer extractor of claim 13 wherein the sensor element is supported on the upper beam.

15. The washer extractor of claim 9 wherein the target element comprises a base portion fastened to the outer surface of the inner door and a upright portion that extends away from the outer surface of the inner door.

16. The washer extractor of claim 9 wherein each inner door is movable in a radially inward direction relative to the respective second opening to a lowered position between the closed position and the open position.

* * * * *